US005425409A

United States Patent [19]

Guia

[11] Patent Number: 5,425,409

[45] Date of Patent: Jun. 20, 1995

[54] DOOR MOUNTING SYSTEM

[76] Inventor: Armando E. Guia, 3ea. Av. entre transversales 8y9, Qta. Los Guia, Altamira, Caracas, Venezuela

[21] Appl. No.: 168,431

[22] Filed: Dec. 17, 1993

[51] Int. Cl.[6] ..... E05F 1/00

[52] U.S. Cl. ..... 160/201; 160/209

[58] Field of Search ..... 160/201, 209, 207; 49/197

[56] References Cited

U.S. PATENT DOCUMENTS

| | | | |
|---|---|---|---|
| 1,925,574 | 9/1933 | Scott | 160/209 X |
| 2,252,139 | 8/1941 | Schlacter | 160/201 |
| 2,855,989 | 10/1958 | Pritchard . | |
| 3,927,709 | 12/1975 | Anderson . | |
| 4,119,133 | 10/1978 | Wolf . | |
| 4,269,253 | 5/1981 | Ziegler . | |
| 4,676,293 | 6/1987 | Hanssen . | |
| 4,732,203 | 3/1988 | Alten . | |
| 4,793,397 | 12/1988 | Whiteman . | |
| 4,878,529 | 11/1989 | Hormann . | |
| 5,002,114 | 3/1991 | Hormann . | |

FOREIGN PATENT DOCUMENTS

| | | | |
|---|---|---|---|
| 657377 | 2/1963 | Canada | 160/201 |
| 83354 | 4/1957 | Denmark | 160/201 |
| 367852 | 5/1990 | European Pat. Off. | 49/197 |
| 894667 | 7/1949 | Germany | 49/197 |
| 3911187 | 10/1990 | Germany | 49/197 |
| 671430 | 8/1989 | Switzerland | 49/197 |

*Primary Examiner*—Blair M. Johnson

*Attorney, Agent, or Firm*—Townsend and Townsend Khourie and Crew

[57] ABSTRACT

An improved door mounting system which uses a pair of channel members directly coupled to a guide member to allow an access door to move from a position closing an access opening to a position clearing the access opening. The door can be a single panel or a number of hingedly interconnected panels. The door is movable laterally into a position or vertically. The door does not "swing, but it "slides", shifts or moves relative to and along the walls in contact with the ends of the panels. The particular door assembly of the present invention is for solving the following geometric problem: finding the geometrical locus of a center of a straight line segment when two ends of the segment are forced to move along two perpendicular straight lines.

12 Claims, 4 Drawing Sheets

FIG.1
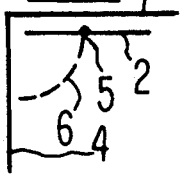
FIG.1A
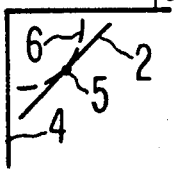
FIG.1B
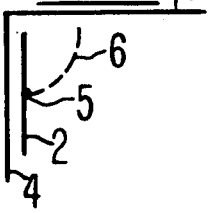
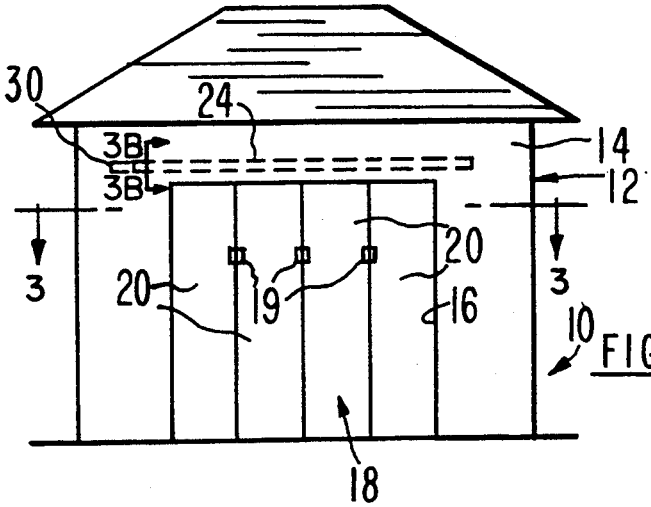
FIG.2
FIG.3
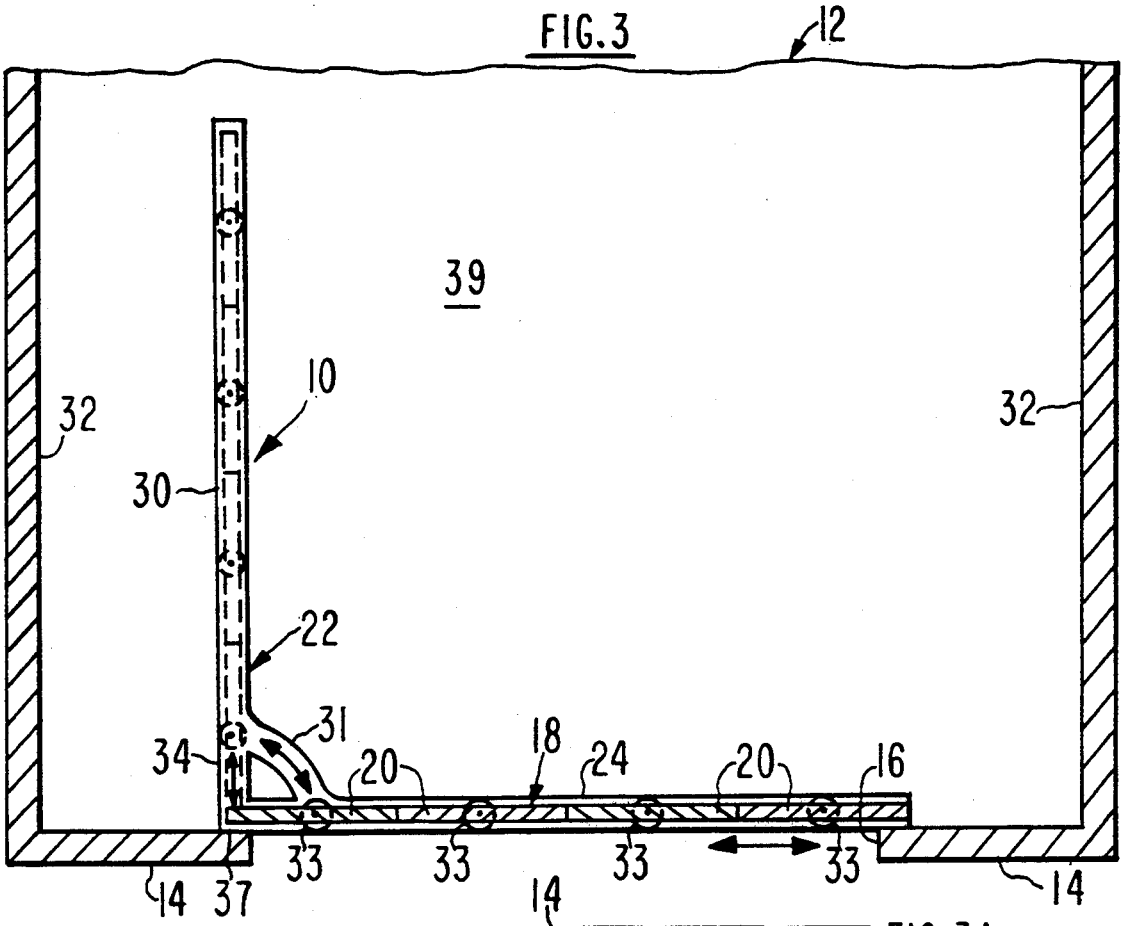
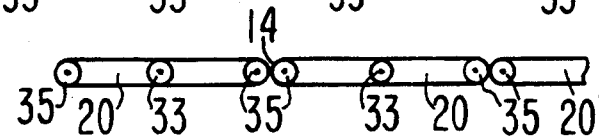
FIG.3A

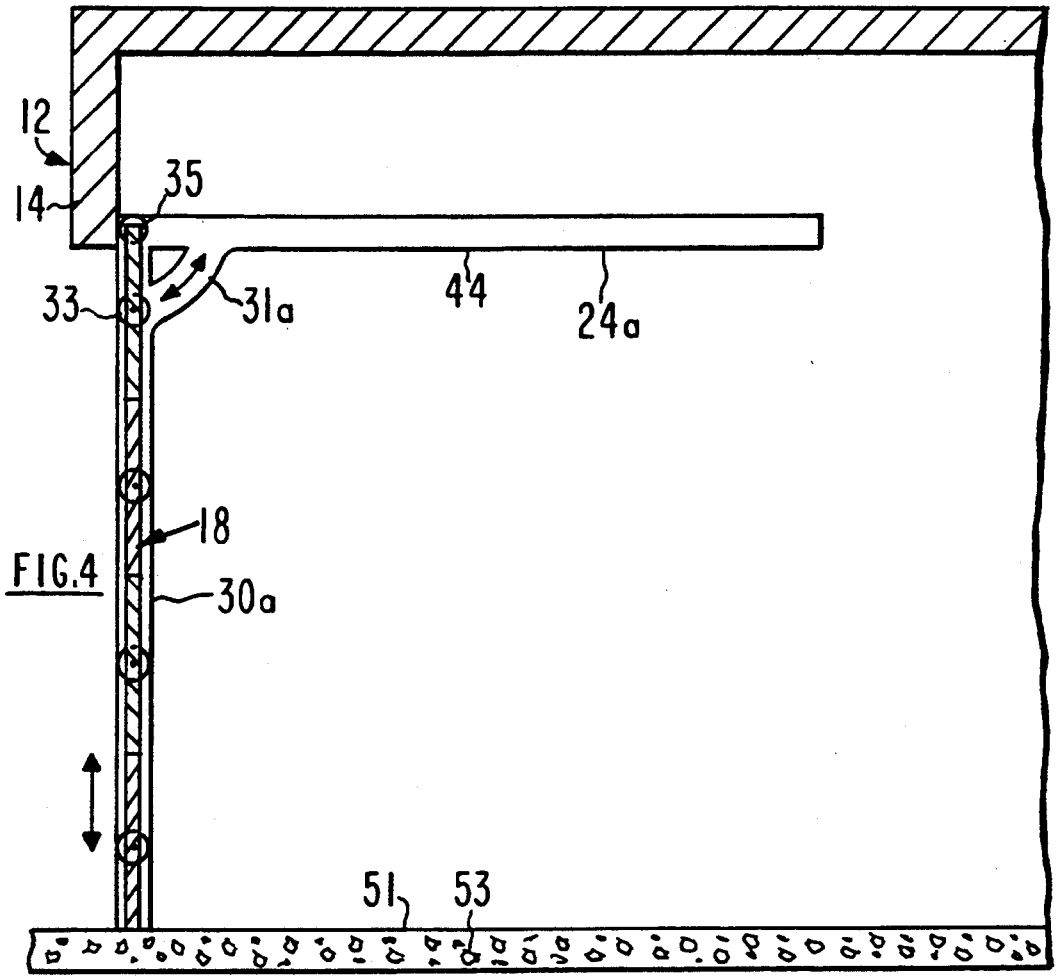
FIG.4
FIG.4A
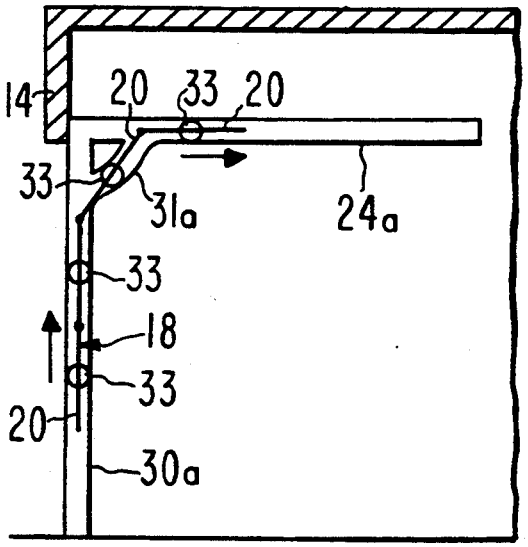
FIG.4B
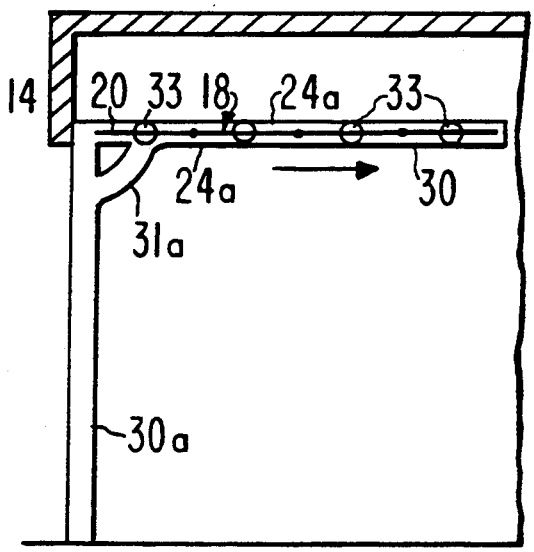

DOOR MOUNTING SYSTEM

This invention relates to improvements in the mounting of doors such as doors for garages, buses and other installations requiring the opening and closing of access openings of different types.

BACKGROUND OF THE INVENTION

The use of channel members for mounting a garage door and the like is old and unpatentable. Typically, channel members are mounted on both sides of an access opening to be covered by a door to guide the door as it moves from a vertical position closing the opening to an elevated, horizontal position clearing the opening. The door generally is made up of hinged panels which permit the door to articulate as it moves from the vertical position to the horizontal position and return.

It is desirable to simplify the system used for mounting the door for movement between the vertical and horizontal positions. It is especially preferred that the system be made in a way so as to minimize the amount of structure of the system such that the system will not interfere with the movement of the door while allowing maximum use of the space adjacent to the door. Based upon this aim, a need has continued to exist for improvements in the mounting of access doors for garages, buildings, buses and the like, and the present invention satisfies this need.

SUMMARY OF THE INVENTION

The present invention is directed to an improved door mounting system which uses a pair of channel members directly coupled together or by way of a guide member to allow an access door to move from a position closing an access opening to a position clearing the access opening. The foregoing door movements can be accomplished when the door is formed by a single panel or formed of a number of hingedly interconnected panels. The door is movable laterally into a position adjacent to the side of the opening or vertically into an elevated horizontal position overlying the floor of the garage or building. The present invention, therefore, provides for several different embodiments of the door mounting system, each of the embodiments being somewhat dependent upon the availability of space for accommodating lateral and vertical movements of the door. When the optimum configuration of the door is selected, the mounting requirements for the door permit the door to be quickly and easily mounted in place using a minimum amount of hardware and concealing such hardware to thereby provide a workman-like appearance for the system also presents a durable, rugged mount for the door and a trouble free and inexpensive to produce and maintain.

The basis for the door mounting system of the present invention is shown schematically in FIGS. 1, 1A, and 1B. To this end, a first flat panel or door 2 is adjacent to one of a pair of mutually perpendicular flat sides or walls 3 and 4. The door can be made of a single panel or several hingedly interconnected panels. The center of the panel 2 moves along a curved path 6 when it is desired to move the door 2 from the FIG. 1 position to the Fig. 1B position. This curved path can be mathematically determined.

The door 2, shown as a single panel, does not "swing" to the FIG. 1B position but it "slides", shifts or moves relative to and along the walls 3 and 4. So long as the center portion of panel 2 moves along the curved path 6 as shown in FIGS. 1, 1A and 1B, the door can be moved from the FIG. 1 position to the FIG. 1B position. In a central part 5 of door 2, a channel is provided to guide the central portion of the door panel along the predetermined, angled path 6 as the ends of the door move along and engage the sides 3 and 4.

The reason for the particular door movement is for the purpose of solving the following simple geometric problem: finding the geometrical locus of a center of a straight line segment when two ends of the segment are forced to move along two perpendicular straight lines. The solution to this problem is the structural basis of the guide system of the present invention.

The primary object of the present invention is to provide an improved door mounting system which can be used in a number of different door closing and opening applications, including access doors to garages, buildings, warehouses, buses and other structures, wherein the system is simple and rugged in construction and relies upon channel members to guide a door into open and closed positions quickly and easily and with the use of a minimum amount of hardware for mounting the door.

Another object of the present invention is to provide a channel guide for connecting a pair of channel members together to form a door mount in which the door may be moved laterally or vertically depending upon the amount of space available for mounting the door and the door itself can be made of a single panel or groups of panels hinged together.

Other objects of this invention will become apparent as the specification progresses, reference being had to the accompanying drawings for an illustration of the invention.

BRIEF DESCRIPTION OF THE DRAWINGS

FIGS. 1, 1A and 1B are schematic views of a door panel to illustrate the teachings of the present invention;

FIG. 2 is a front elevational view of a garage or other building structure having an access opening to be opened and closed by the use of door mounting system of the present invention, showing a door closing the opening and the door having vertical panels hingedly interconnected for movement of the door laterally of the opening when it is desired to clear the opening;

FIG. 3 is a horizontal section through the building structure of FIG. 2, taken along line 3—3 of FIG. 2;

FIG. 3A is a schematic view of the hinged connection between a pair of adjacent door panels of FIG. 2;

FIG. 4 is a view similar to FIG. 3 but showing a door having horizontal panels and movable from a vertical position closing the opening to an elevated position overlying the floor of the building structure;

FIG. 4A and 4B shows schematically the positions of the door of FIG. 4 at various stages of upward movement thereof with respect to the opening;

Figure 5:
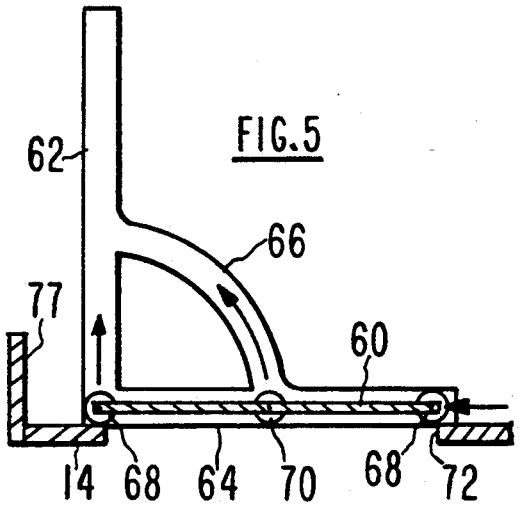
FIGS. 5, 5A and 5B are schematic top plan views of the mounting structure of the present invention, showing the way in which a door of a single panel is used to close and clear an access opening, such as the opening of the building structure of FIG. 2.
Figure 8:
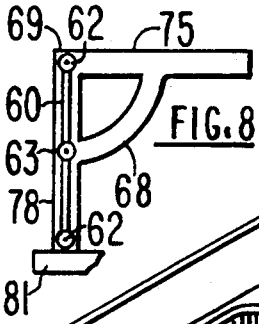

FIG, 7 is an enlarged, perspective view of the guide of FIG, 6;

FIG. 8 is a view similar to FIG. 5 but showing the door movable from a vertical position to a horizontal position when the corresponding access opening is alternately blocked and cleared; and FIG, 9 is a top plan view of a door of a bus showing the way in which the mounting means of the present invention mounts the door to allow egress through the door by a person standing in the well adjacent to the door,

DETAILED DESCRIPTION OF SPECIFIC EMBODIMENTS

The door mounting system of the present invention is usable in a wide variety of applications. However, for purposes of illustration, the system is broadly denoted by the numeral 10 and will be described hereinafter as being used to mount a door 18 of a building structure 12, specifically a garage. The door is to be mounted so that it can close an access opening 16 in a wall 14 of building structure 12. The door 18 is shown in FIG. 2 as being comprised of a number of vertical panels 20 which are hingedly interconnected together by hinges 19 for rotation about vertical axes. Thus, the door articulates as it moves from the position shown in FIG. 2 in which it closes access opening 16 toward and into a position inside building structure or garage 12 in a manner to be described.

System 10 in a first embodiment, includes an L-shaped body 22 comprised of rails or channel members 24 and 30 (FIG. 3). Rail or channel member 24 is in spanning relationship to the dimension identified as the upper end of the access opening 16 (FIG. 3). The channel member 24 is mounted in the dashed line position of FIG. 2 above the upper end of opening 16. Thus, channel member 20 will not be seen by an observer looking at the front face of building structure 12. The ends of channel member 24 can be secured in a suitable manner to the roof of building structure 12 or to the inner surface of the front wall 14. Fasteners can be used thereof for attachment to wall 14.

The second rail or channel member 30 extends away from opening 16 and is generally perpendicular to wall 14 as shown in FIG. 3. Rail 30 extends into the interior space of building structure 12., and any suitable fastener means can be used to mount the rail or channel member 30 in a horizontal position in which it forms an L-shaped configuration for the body 22 by virtue of the fact that adjacent ends of channel members 24 and 30 are rigidly coupled directly to each other or by way of a guide hereinafter described with reference to FIG. 2. When properly mounted, channel members 24 and 30 are in a horizontal plane and the plane is elevated with respect to the floor of the building structure 12.

Figure 3C:
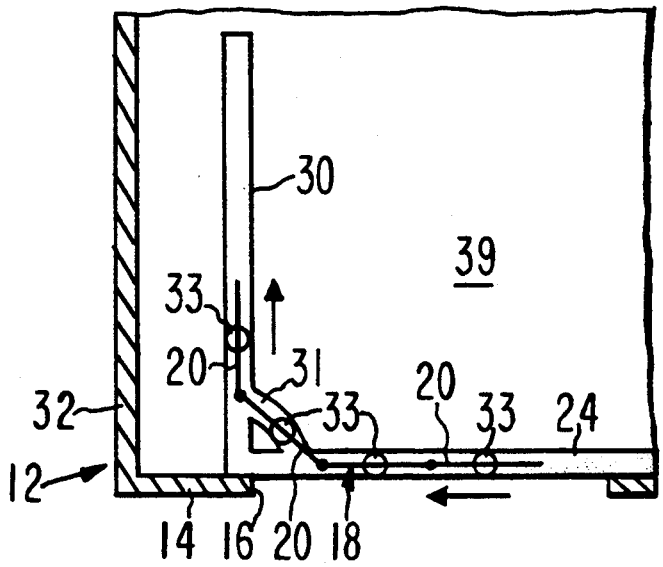
FIG. 3C and 3D are schematic views of the door mount of FIG. 3.
Figure 3D:
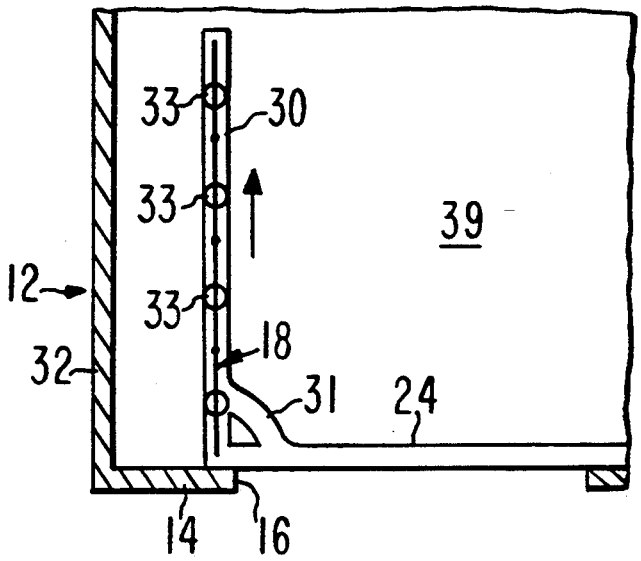
Figure 3B:
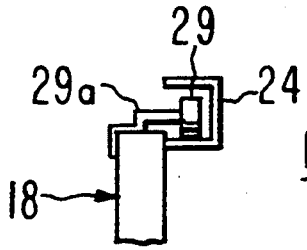
FIG. 3B is a cross-sectional view taken along line 3B—3B of FIG. 2.

The rails or channel members 24 and 30 have C-shaped channels 27 as shown in FIG. 3B. The side of each channel facing into the garage is open to receive a projection, such as a roller 29, mounted on an L-shaped hinge member and extending into the adjacent open, side of door 18. The channel of channel member 30 is the same configuration as to and spaced from that shown in FIG. 3B.

A channel segment 31 having the cross-sectional shape of channel 27 is open at the ends thereof and is secured to channel members 24 and 30 to form a curved path near the junction between the channel member 24 and 30. This channel segment 31 corresponds to the central part of panel 2 shown in FIGS. 1, 1A and 1B, such central part being movable along the dashed line path 6 of FIGS. 1, 1A and 1B. The curvature of channel segment 31 will be described hereinafter.

Each panel 20 of door 18 has a central part provided with a projection 33 in the nature of a roller which is rotatably mounted on the upper end face (FIG. 3B) of each door panel 20, respectively. The projection could be a sliding member which does not rotate, if desired, however, it is preferable that a roller be used to minimize friction effects.

FIG. 3A shows a projection 35 on each of the opposed ends of a panel 20 of the door 18. These projections 35 may be rollers, in which case they will be in rolling relationship in the channels of channel members 24 and 30 as shown in FIG. 3B. The projections could be sliding as well as rolling, and it is preferable that each panel 20 will have a pair of rollers 35 although it is possible that only one roller is needed at the junction between each pair of adjacent panels 20 to reduce production costs.

The upper margin of door 18 is adjacent to the open-side of the channel 27 of channel member 24 as shown in FIG. 3B. In FIG. 3, door 18 is in closing relationship to opening 16 while the door is provided with this upper margin adjacent to channel 27 (FIG. 3B). Although FIG. 3B shows the upper margin 18*a* of a panel 20 of door 18, it is to be understood that the upper margin of each door panel 20 is guided by the channels 27 and channel segment 31 when the door is mounted at this upper margin in the channels 27 of channel members 24 and 30.

It is possible and indeed preferable that there be no right-hand (when viewing FIG. 3) channel member 24 because such a second channel member 30 is not needed for the functioning of the door 18. The door moves from the full-line position of FIG. 3 to the dashed line position as the left-hand end of door 18 moves inwardly relative to the access opening 16 and has the central, intermediate rollers or projections 33 move successively into and through channel segment 31.

Channel 27 is open at the side (FIG. 3B). To stabilize and support channel member 30, it is supported by rollers in the channels of channel members. The channel member 30 (FIG. 3) is rigid with respect to wall 14. Also, channel member 30 may be secured to the adjacent sidewall 32 of building structure 12.

In use, door 18 with articulated panels 20 is mounted with the rollers 33 and 35 (FIG. 3A) in the channels 27 of channel member 24. In such position, the right-hand margin of the door will overlap the inner surface of the wall 14 and the left-hand margin of the door will be at the junction of channel members 24 and 30. The left-hand panel 20 of door 18 will have its roller 33 aligned with the channel segment 31.

When it is desired to open the door, the left-hand margin 37 (or roller 35) will be caused to move into and toward the innermost end of channel member 30. When this occurs, the roller 33 of the first panel 20 will move into and through channel segment 31 and then enter and move longitudinally of channel member 30. The channel member moves to a retracted position inside the building structure 12 where it is stored until a later time. In moving to the dashed line position of FIG. 3, the door clears opening 16 and allows entrance into and egress from, the space 39 of building structure 12. FIG.

3C shows the door as it is partially moved from a position closing the opening to a position particularly clearing the opening. FIG. 3D shows the door 18 in its retracted or stand-by position in which the opening 16 is cleared.

The foregoing discussion was made with respect to an articulated door 18 having hinged panels 20. Also, the door of FIGS. 3C and 3D is movable in the horizontal or lateral direction from right to left when viewing FIG. 3C. Also, since the door is movable laterally, channel members 24 and 30 and segment 31 are all in a common, horizontal elevated plane. A criterion used with the embodiment of FIGS. 3, 3C and 3D is that the width of each panel 20 is twice the center radius of the curved segment 31. Other dimensions of the curved segment 31 will be described hereinafter.

If it is desired to mount the door 18 for movement vertically from a closed position into a horizontal position, the mounting structure of FIGS. 4, 4A and 4B is used. In this respect, the door mounting system is denoted by the numeral 30*a* (FIG. 4) and includes a first rail or channel member 24*a* and a second rail or channel member 30*a* which are perpendicular to each other as shown in FIG. 4 and are interconnected by a curved channel segment 31*a*. The three components, namely channel members 24*a* and 30*a* and segment. 31*a*, are all in a common vertical plane which is perpendicular to the plane of the opening 16. The junction between channel members 24*a* and 30*a* is secured in simple manner to wall 14 and channel members 24*a* and 30*a* are secured in any suitable manner to adjacent structure. For instance, the lower end of channel member 30*a* is supported on the upper surface 51 of a concrete slab 53 which forms the base for the building structure 12. Also, there may be a second pair of channel members 24*a* and 30*a* laterally spaced from the channel members shown in FIG. 4. However, only a single pair of channel members, namely channel members 24*a* and 30*a*, are necessary to carry out the teachings of the present invention. The curvature of segment 31*a* will be discussed with respect to FIGS. 6 and 7 to be described.

In use, door 18 typically is closed and is in blocking or closing relationship to opening 16 as shown in FIG. 4. The door when adjacent to channel member 30*a*, closes the opening. The door has rollers 33 and 35 as shown in FIG. 3A. The channel members 24*a* and 30*a* have open sides for the channels 27*a* thereof. The side of channel member 24*a* facing the interior of the building structure 12 is open as are the side of the channel member 30*a* which extends into and toward the opening 16. Thus, rollers 33 and 35 will present projections extending into the channels of the channel members so as to serve as guides as the door is moved in the closed position of FIG. 4 to the open position of FIG. 4B.

In operation, channel members 24*a* and 30*a* are mounted in the positions shown in FIG. 4 with all three components namely channel members 24*a* and 30*a* and channel segment 31*a* being in a vertical plane. When it is desired to open the door, the door is lifted and the end roller 35 will start to move into channel member 24*a* as shown in FIG. 4A. The first central roller 33 will move into and through segment 31*a* as also shown in FIG. 4A. Finally, all of the rollers of the panels of door 18 will have passed into channel member 24*a* so that the door 18 clears opening 16 as shown in FIG. 4B.

A criterion for efficient operation of system 10*a* is that the height of each panel 20 is twice the center radius of the curved segment 31*a*.

Figure 5A:
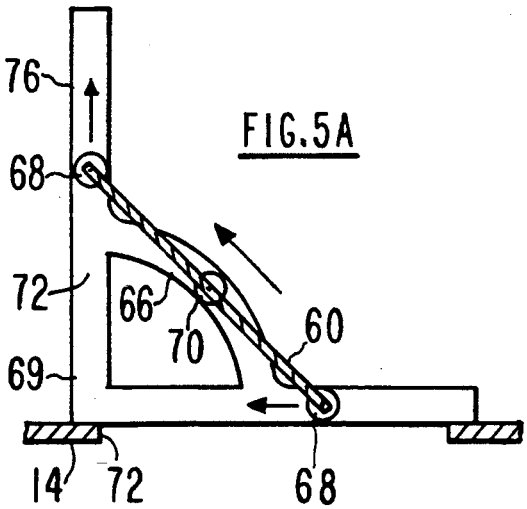
Figure 5B:
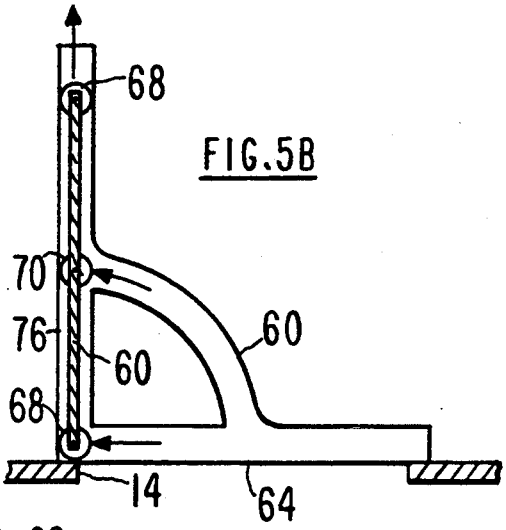

The foregoing description has been made with respect to a door having either hinged vertical panels or hinged horizontal panels. It is possible to carry out the teachings of the present invention with a garage door 60 of a single panel in association with channel members 62 and 64 and curved channel segment 66 (FIGS. 5–8). FIG. 5 shows door 60 with roller 68 and 70 at the ends and central portion of the door. It is assumed that the garage has an opening 72 where panels extend downwardly from the channel member 64. In use, rollers 68 follow along respective channel members 62 and 64 while central roller 70 moves into and through curve segment 66. This moves the door from a position closing the opening 72 (FIG. 5) through a half-closed position shown in FIG. 5B to an open position (FIG. 5B).

In this case, the channel members 62 and 64 and the curved segment 66 are all in a generally horizontal elevated plane which is a plane near the upper end of opening 72, such as in the location of channel member 24, shown in FIG. 2. The door can be closed by moving it in a reverse direction, from the FIG. 5B position to the FIG. 5 position.

Figure 6:
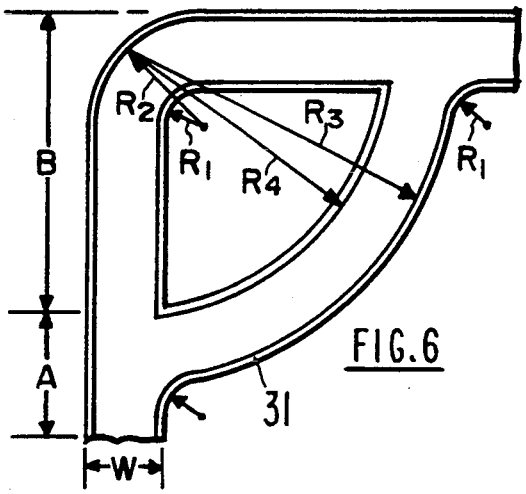
FIG. 6 is a side elevational view of a guide which is to be fitted to channel members or rails to mount a door for movement from a closing position to a clearing position with respect to an access opening.
Figure 7:
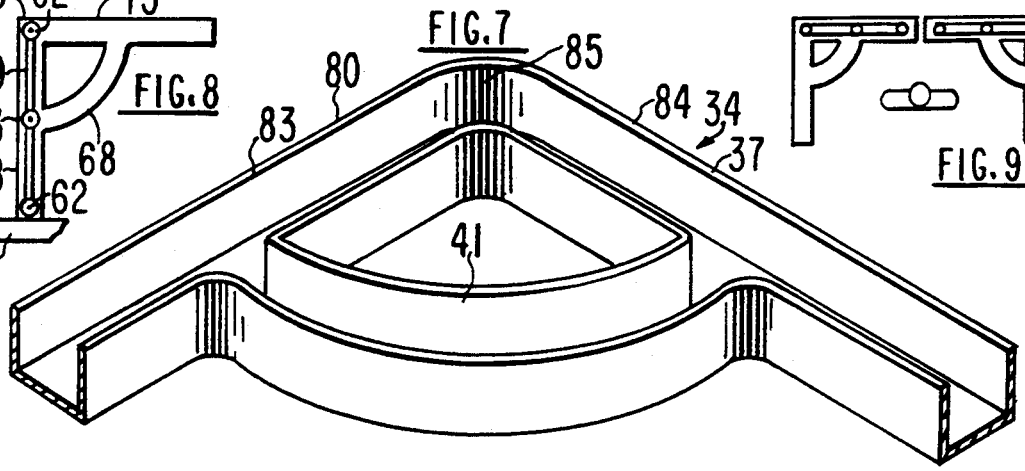

The dimensions of segment 31 (segment 66 of FIGS. 5, 5A and 5B) are shown in FIG. 6. These dimensions are all relevant to each other in accordance with equations as follows:

$$B=(R_3+R_4)/2$$

A>B, wherein A minimum equal to B_W $$R_3=R_4+W$$

$$R_2=R_1+W$$

Panel Width (Height)$=R_3+R_4$

Thus, the equations give the panel width or height, depending upon which type of door is used.

It is possible to make a guide 80 which is adapted to cooperate with channel members 75 and 78 (shown in FIG. 8). The channel members 75 and 78 are coupled together in some suitable manner and the guide 80 can be of a single piece of plastic or other molded material. In the alternative, it could be made of wood, metal or other wear-resistant material. It is clear from FIG. 7 that the segment 82 is curved and mates with and communicates with the adjacent channel sides 83 and 84 having a common junction 85.

Figure 9:
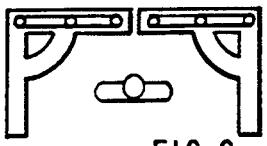

FIG. 9 illustrates a version of the present invention as applied to an exit door of a bus. A passenger can stand in the door well and wait until the door shifts to an open position, in which case the door panels move in the manner shown above with respect to FIG. 4, there being no interference with the person standing in the well because of the way in which the door articulates relative to the opening which is closed by the door.

Although the foregoing invention has been described in some detail by way of illustration and example, for purposes of clarity of understanding, it will be obvious that certain changes and modifications may be practiced within the scope of the appended claims.

What is claimed is:

1. A door system for a structure having an elongated access opening to be opened and closed with the opening having a number of parameters comprising:

an L-shaped channel body having a pair of interconnected channel members, each of said channel members having a channel, there being a junction at the location where the channel members are interconnected, one of the channel members adapted to be placed adjacent to and to extend along one parameter of the opening, the other channel member being perpendicular to said one parameter of the opening and adapted to extend away from the opening; a curved channel segment having a channel spanning the distance between the channel members at locations near to and spaced from said junction; the curvature of said channel segment being concave in relation to said junction and a door having at least one panel, each panel having a margin provided with a pair of spaced end guides and a central guide between and spaced from the end guides, the end guides being movable from the channel of said one channel member through the junction and then to the channel of the other channel member, said central guide being movable in the channel of the channel segment from the channel of said one channel member to the channel of the other channel member as the end guides move successively from the channel of said one channel member and into the channel of the other channel member in bypassing relationship to the channel of the channel segment, whereby the door can be moved from a first position closing the opening to a second position clearing the opening and return.

2. A door system as set forth in claim 1, wherein the first and second channel member and the channel segment are in a generally horizontal plane, whereby the door is movable laterally of the opening.

3. A door system as set forth in claim 1, wherein the first and second channel members and the channel segment are in a vertical plane, whereby the door is movable vertically and then horizontally.

4. A door system as set forth in claim 1, wherein the door is a single panel.

5. A door system as set forth in claim 1, wherein the door is comprised of a plurality of panels, each pair of adjacent panels being hingedly interconnected with each other, whereby the door is articulated as it moves from the first position to the second position and return.

6. A door system as set forth in claim 1, wherein the door is a single panel, said spaced end guides including a pair of end rollers, said central guide including a central roller.

7. A door system as set forth in claim 1, wherein the door is comprised of a plurality of hingedly interconnected panels for articulation of the door as it moves between the first and second positions and return, each door panel having a central roller defining the corresponding central guide, said roller being rotatably mounted on the panel for movement through the channel segment as the end guider of each panel move along and out of said one channel member and into said other channel member.

8. A door system as set forth in claim 1, wherein is included a building structure having an access opening to be closed by the door, said one channel member extending along said structure adjacent to and above the upper end of said opening, said one and said other channel members and the channel segment being in a generally horizontal plane.

9. A door system as set forth in claim 1, wherein is included a building structure having an opening to be closed by the door, said one channel member being adjacent to one side of the opening and said other channel member being at the top of the one channel member and extending away from the opening and into the building structure, said channel members and said channel segment being in a vertical plane.

10. A door system for a building having an access opening to be closed and opened comprising:

a pair of elongated channel members, each channel member having an end and a longitudinal axis, the members being oriented relative to each other such that the longitudinal axes of the channel members intersect at a location spaced from respective ends of the channel members, and a channel guide interconnecting the ends of the channel members, said channel guide having a pair of longitudinally straight channel elements provided with outer ends coupled with the adjacent ends of, respectively, the channel members, said channel guide having a corner junction near the adjacent ends of the channel elements and a curved central channel segment connected to the channel elements of the guide channel, the curvature of said central channel segment being concave in relation to said junction, each channel member being adapted to support a door having a pair of end guides and a central guide between the end guides, to allow the door to move from supported relationship by one channel member to supported relationship by the other channel member, said central guide of the door being movable in the central channel segment between the channel members as the end guides of the door move from one of the channel members through the channel elements in bypassing relationship to the central channel segment and into the other channel members.

11. A door assembly as set forth in claim 10 wherein the channel members and the guide channel are in a horizontal plane.

12. A door assembly as set forth in claim 10 wherein the channel members and the central channel guide are in a vertical plane.

* * * * *